US006729945B2

(12) United States Patent
Xu et al.

(10) Patent No.: US 6,729,945 B2
(45) Date of Patent: May 4, 2004

(54) APPARATUS FOR CONTROLLING LEADING EDGE AND TRAILING EDGE POLISHING

(75) Inventors: Cangshan Xu, Fremont, CA (US); Jeff Gasparitsch, Fremont, CA (US); Robert Taff, Brentwood, CA (US); Kenneth J. Bahng, Cupertino, CA (US); Paul Stasiewicz, Fremont, CA (US); Erik H. Engdahl, Livermore, CA (US)

(73) Assignee: Lam Research Corporation, Fremont, CA (US)

( * ) Notice: Subject to any disclaimer, the term of this patent is extended or adjusted under 35 U.S.C. 154(b) by 25 days.

(21) Appl. No.: 09/823,722

(22) Filed: Mar. 30, 2001

(65) Prior Publication Data

US 2002/0146972 A1 Oct. 10, 2002

(51) Int. Cl.[7] ..... B24B 21/08
(52) U.S. Cl. ..... 451/303; 451/307
(58) Field of Search ..... 451/5, 24, 296, 451/303, 307, 41

(56) References Cited

U.S. PATENT DOCUMENTS

| | | | | |
|---|---|---|---|---|
| 5,558,568 A | | 9/1996 | Talieh et al. | |
| 5,593,344 A | * | 1/1997 | Weldon et al. | 451/296 |
| 5,692,947 A | | 12/1997 | Talieh et al. | |
| 5,722,877 A | | 3/1998 | Meyer et al. | |
| 5,800,248 A | | 9/1998 | Pant et al. | |
| 5,916,012 A | | 6/1999 | Pant et al. | |
| 5,961,372 A | * | 10/1999 | Shendon | 451/41 |
| 5,980,368 A | * | 11/1999 | Chang et al. | 451/303 |
| 6,086,456 A | * | 7/2000 | Weldon et al. | 451/41 |
| 6,155,915 A | * | 12/2000 | Raeder | 451/285 |
| 6,358,118 B1 | * | 3/2002 | Boehm et al. | 451/24 |

FOREIGN PATENT DOCUMENTS

| | | |
|---|---|---|
| EP | 0 706 857 A | 4/1996 |
| EP | 0 914 906 A | 5/1999 |
| WO | WO 00 25982 A | 5/2000 |

* cited by examiner

*Primary Examiner*—Robert A. Rose
(74) *Attorney, Agent, or Firm*—Martine & Penilla, LLP

(57) ABSTRACT

A platen for use in chemical mechanical planarization (CMP) systems is disclosed. The platen is arranged below a linear polishing pad and designed to apply a controlled fluid flow to the underside of the linear polishing pad. The platen includes a leading zone containing a first plurality of output holes. The leading zone is oriented more proximate to an upstream region of the linear polishing pad. The platen also includes a trailing zone containing a second plurality of output holes. The trailing zone is oriented more proximate to a downstream region of the linear polishing pad. The leading zone and the trailing zone are independently controlled and designed to output the controlled fluid flow independently from each of the first plurality of output holes and the second plurality of output holes.

23 Claims, 11 Drawing Sheets

APPARATUS FOR CONTROLLING LEADING EDGE AND TRAILING EDGE POLISHING

BACKGROUND OF THE INVENTION

1. Field of the Invention

The present invention relates to chemical mechanical planarization (CMP) techniques and, more particularly, to the efficient, cost effective, and improved CMP operations.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess material.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material or polyurethane in conjunction with other materials such as, for example a stainless steel belt. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

FIG. 1A shows a linear polishing apparatus 10 which is typically utilized in a CMP system. The linear polishing apparatus 10 polishes away materials on a surface of a semiconductor wafer 16. The material being removed may be a substrate material of the wafer 16 or one or more layers formed on the wafer 16. Such a layer typically includes one or more of any type of material formed or present during a CMP process such as, for example, dielectric materials, silicon nitride, metals (e.g., aluminum and copper), metal alloys, semiconductor materials, etc. Typically, CMP may be utilized to polish the one or more of the layers on the wafer 16 to planarize a surface layer of the wafer 16.

The linear polishing apparatus 10 utilizes a polishing belt 12, which moves linearly in respect to the surface of the wafer 16. The belt 12 is a continuous belt rotating about rollers (or spindles) 20. The rollers are typically driven by a motor so that the rotational motion of the rollers 20 causes the polishing belt 12 to be driven in a linear motion 22 with respect to the wafer 16.

The wafer 16 is held by a wafer carrier 18. The wafer 16 is typically held in position by mechanical retaining ring and/or by vacuum. The wafer carrier positions the wafer atop the polishing belt 12 so that the surface of the wafer 16 comes in contact with a polishing surface of the polishing belt 12.

FIG. 1B shows a side view of the linear polishing apparatus 10. As discussed above in reference to FIG. 1A, the wafer carrier 18 holds the wafer 16 in position over the polishing belt 12 while applying pressure to the polishing belt. The polishing belt 12 is a continuous belt typically made up of a polymer material such as, for example, the IC 1000 made by Rodel, Inc. layered upon a supporting layer. The polishing belt 12 is rotated by the rollers 20 which drives the polishing belt in the linear motion 22 with respect to the wafer 16. In one example, a fluid bearing platen 24 supports a section of the polishing belt under the region where the wafer 16 is applied. The platen 24 can then be used to apply fluid against the under surface of the supporting layer. The applied fluid thus forms a fluid bearing that creates a polishing pressure on the underside of the polishing belt 12 which is applied against the surface of the wafer 16. Unfortunately, because the polishing pressure produced by the fluid bearing typically cannot be controlled very well, the polishing pressure applied by the fluid bearing to different parts of the wafer 16 generally cannot be separately managed. Therefore, prior art fluid bearings generally do not accurately control wafer polishing on the leading and trailing edges of the wafer 16.

FIG. 1C shows a linear polishing apparatus 10 illustrating leading edge and trailing edge polishing pad deformations. In this example, a wafer 16 is attached to a carrier 18 and the carrier 18 by use of pressure 13 pushes the wafer 16 down on the polishing belt 12 that is moving in the direction 23 over the platen 24. When the wafer contacts the polishing belt 12, the polishing belt 12 deforms at a leading edge 16*a* and at a trailing edge 16*b*. A deformation 22 occurs at the leading edge 16*a* and a deformation 26 occurs at trailing edge 16*b*. The deformation 16*a* generally causes more polishing pressure on the leading edge 16*a* resulting in more material being removed. The deformation 16*b* generally causes less polishing pressure on the trailing edge 16*b* resulting in less material being removed. Consequently, due to the fact that the prior art polishing belt designs do not properly control polishing dynamics, uneven polishing and inconsistent wafer polishing may result thereby decreasing wafer yield and increasing wafer costs.

Therefore, there is a need for an apparatus that overcomes the problems of the prior art by having a platen that improves polishing pressure control and reduces polishing pad deformation.

SUMMARY OF THE INVENTION

Broadly speaking, the present invention fills these needs by providing an apparatus for independently controlling the leading edge and the trailing edge of a wafer during CMP. The method involves utilizing an improved fluid bearing platen with strategically utilized fluid ports to powerfully control fluid pressure pushing on certain regions of the polishing pad. In this way, polishing pressure in different sections of a wafer may be separately controlled as well as polishing pad deformation during polishing. It should be appreciated that the present invention can be implemented in numerous ways, including as a process, an apparatus, a system, a device or a method. Several inventive embodiments of the present invention are described below.

In one embodiment, a platen assembly for supporting an underside of a linear polishing pad is disclosed. The platen assembly includes a platen surround plate, a platen interface assembly, and a platen manifold assembly. The platen manifold assembly is connected to the platen interface assembly, and the platen manifold assembly is supported by the platen surround plate. The platen manifold assembly includes a base plate, a gasket that fits on the base plate, an o-ring fitting around the platen, and a platen. The platen includes a plurality of separately controllable regions where each of the separately controllable regions is designed to communicate independent fluid flows through the separately controllable regions to the underside of the linear polishing pad.

In yet another embodiment, a platen for mounting under and supporting a linear polishing pad during chemical mechanical planarization (CMP) operations is disclosed. The platen includes a plate that has a plurality of separately controllable regions where each of the separately controllable regions is designed to communicate independent fluid flows through the separately controllable regions to the underside of the linear polishing pad.

In another embodiment, a platen for mounting under and supporting a linear polishing pad during chemical mechanical planarization (CMP) operations is provided. The platen is designed to apply a force to the underside of the linear polishing pad as a wafer is applied to a top surface of the polishing pad. The wafer is applied substantially over the platen so as to define the linear polishing pad between the wafer and the platen. The platen includes a plate having a plurality of output holes where each of the output holes designed to output an fluid flow. The plurality of output holes is separately grouped so as to define a first region and a second region of output holes. The first region is oriented substantially under a leading edge of the wafer and the second region is oriented substantially under the trailing edge of the wafer. The first region of output holes and the second region of output holes is separately controlled so as to apply a different magnitude of the force to the leading edge of the wafer than the trailing edge of the wafer.

The advantages of the present invention are numerous. Most notably, by creating a platen that can fine tune and adjust polishing pressure in the edges of the wafer and reduce deformation of a polishing pad during polishing, wafers produced may be made more uniform which may result in greater wafer yields and lower wafer costs. Specifically, the present invention may independently manage polishing pressures in the leading edge and the trailing edge of the wafer and reduce deformity of the polishing pad as it enters underneath the wafer and exits from underneath the wafer during polishing in a linear belt polishing unit. Such control may be established by individually controlling fluid pressure applied by different zones of a platen to the polishing pad moving over the platen. In addition, the present invention may have even more specific control over polishing pressures within each of the different zones by enabling more precise fluid pressure control within different sub regions of each zone of the platen. Therefore, control of fluid pressure may be controlled even more precisely to optimize fluid pressure applied to the polishing pad. This may result in more controllable polishing pressure on different parts of the polishing pad thereby enabling reduction of deformity of the polishing pad. Consequently, great differences in polishing pressures in different regions of the wafer may be significantly reduced.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

An invention for an apparatus to control leading edge and trailing edge polishing in a CMP process is disclosed. In the following description, numerous specific details are set forth in order to provide a thorough understanding of the present invention. It will be understood, however, by one of ordinary skill in the art, that the present invention may be practiced without some or all of these specific details. In other instances, well known process operations have not been described in detail in order not to unnecessarily obscure the present invention.

In general terms, the present invention is directed toward a platen within a CMP system that has the unique ability to independently control polishing pressure in different regions of the wafer so wafer polishing may be made more consistent and efficient. Specifically, the platen of the present invention can manage the polishing pressures on the leading and trailing edges so any polishing pressure differences and inconsistencies arising from polishing pad pressure dynamics may be compensated for in a highly manageable manner. The platen of the present invention may include any number of pressure zones, each with a plurality of fluid holes that may be utilized to output fluid at different pressures thus compensating for polishing pad dynamics inadequacies. It should be understood that the present invention may be utilized for polishing any size wafer such as for example, 200 mm wafers, 300 mm wafer, etc. Preferably, the present invention may be utilized to fine tune leading edge and trailing edge polishing by reducing disruptions when the polishing pad enters underneath the wafer (the area where the polishing pad enters underneath the wafer may be known as an upstream region) and when the pad exits the wafer (the area where the polishing pad exits the wafer may be known as a downstream region). In one embodiment, the present invention may be utilized to adjust polishing pressures in an area 10–20% of the radius away from the edge of the wafer. In a preferable embodiment, the area where polishing is adjusted is between about 0–5% of the radius away from the edge of the wafer. Such an embodiment may then precisely control polishing on the edges of the wafers.

A fluid as utilized herein may be any type of gas or liquid. Therefore, fluid platens as described below may utilize gas or liquid to control pressure applied by a polishing pad to a wafer by differing pressures on different portions of the polishing pad in contact with different regions of the wafer.

Figure 1A:
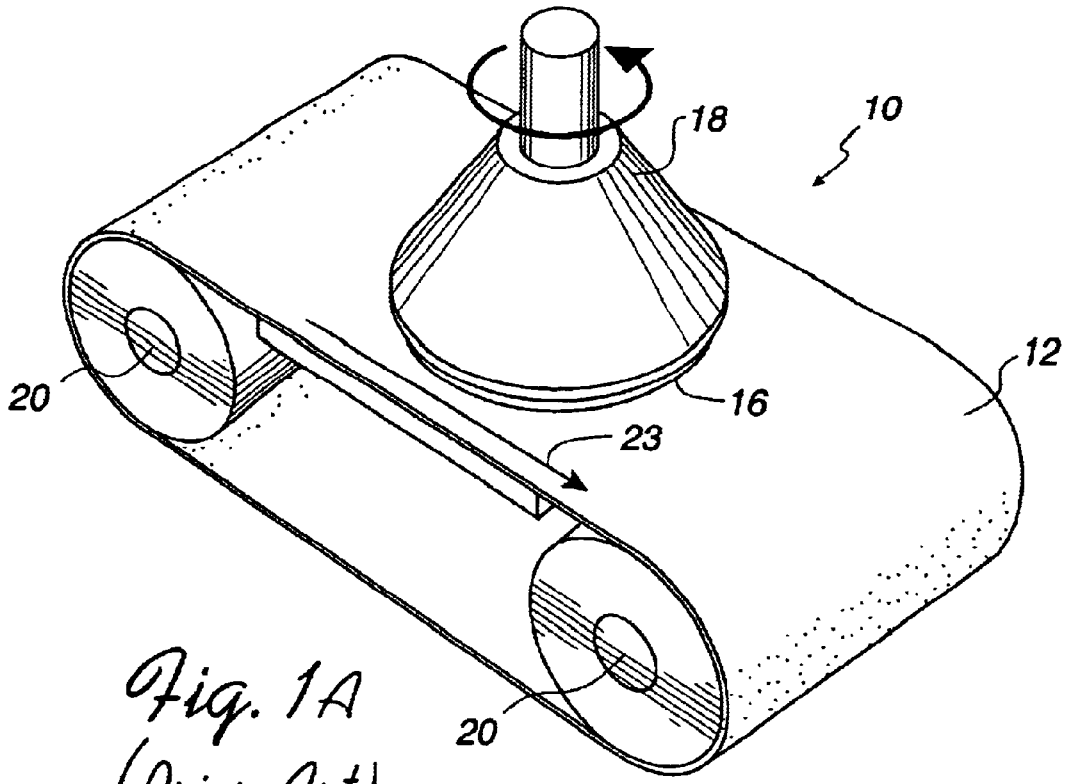
Fig. 1A (Prior Art)
FIG. 1A shows a linear polishing apparatus which is typically utilized in a CMP system.
Figure 1B:
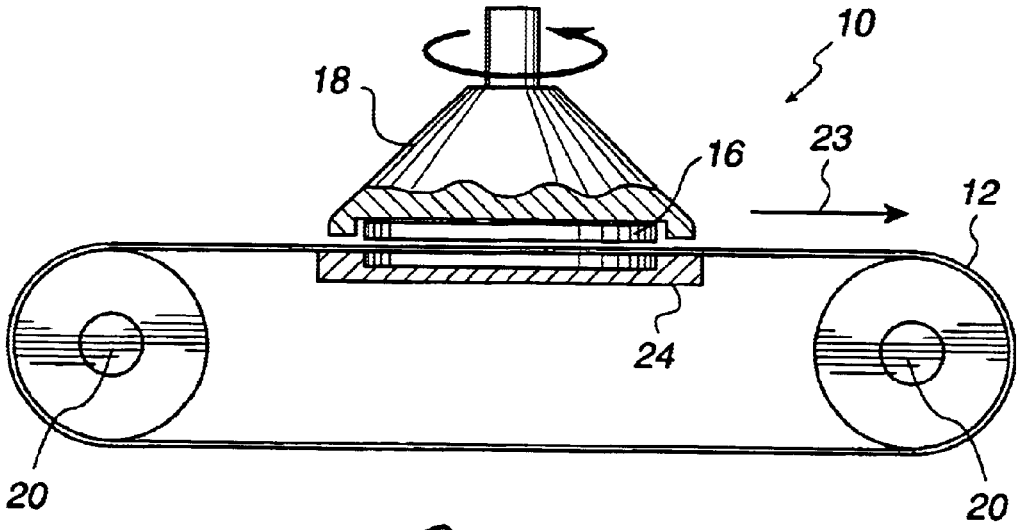
Fig. 1B (Prior Art)
FIG. 1B shows a side view of the linear polishing apparatus.
Figure 1C:
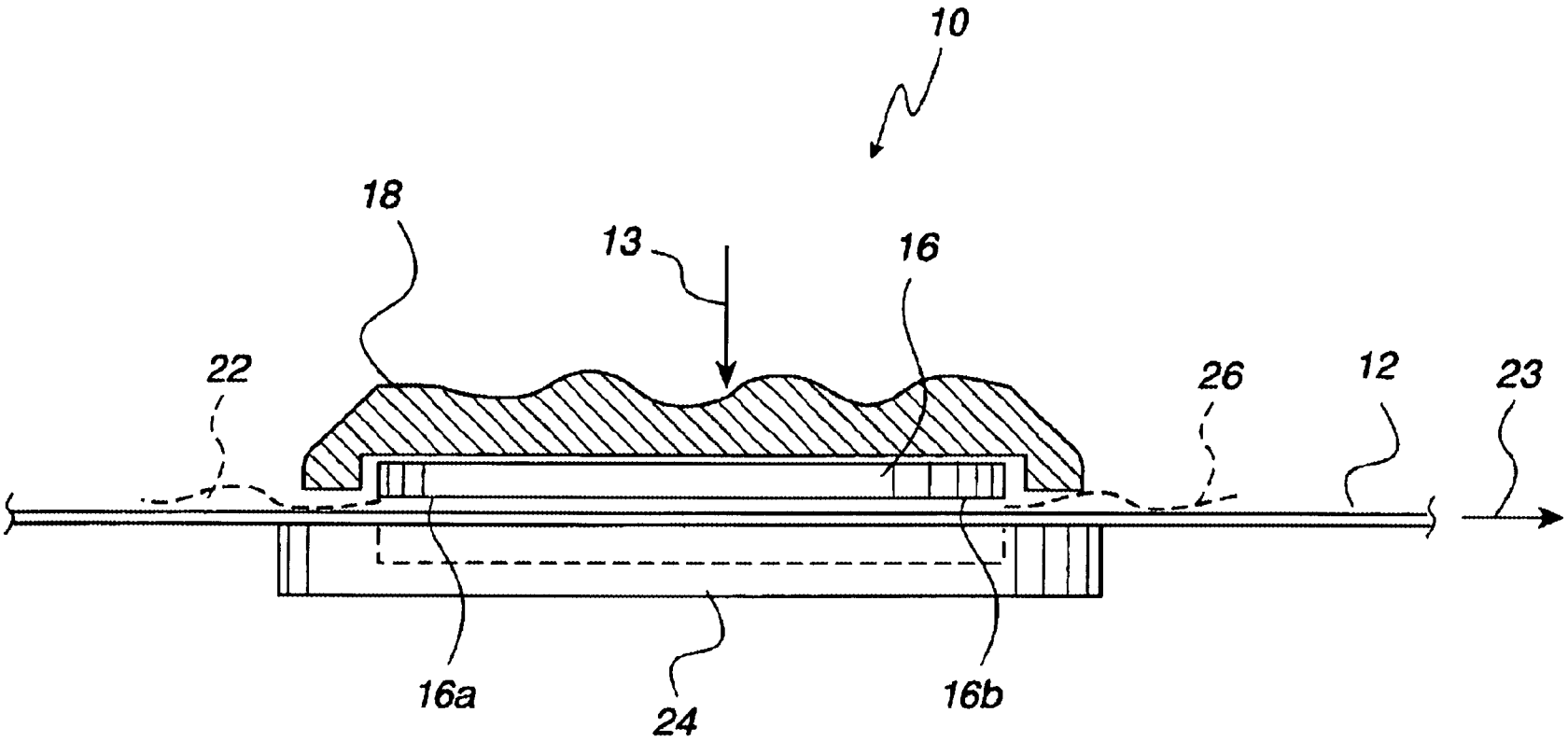
Fig. 1C (Prior Art)
FIG. 1C shows a linear polishing apparatus illustrating leading edge and trailing edge polishing pad deformations.
Figure 2A:
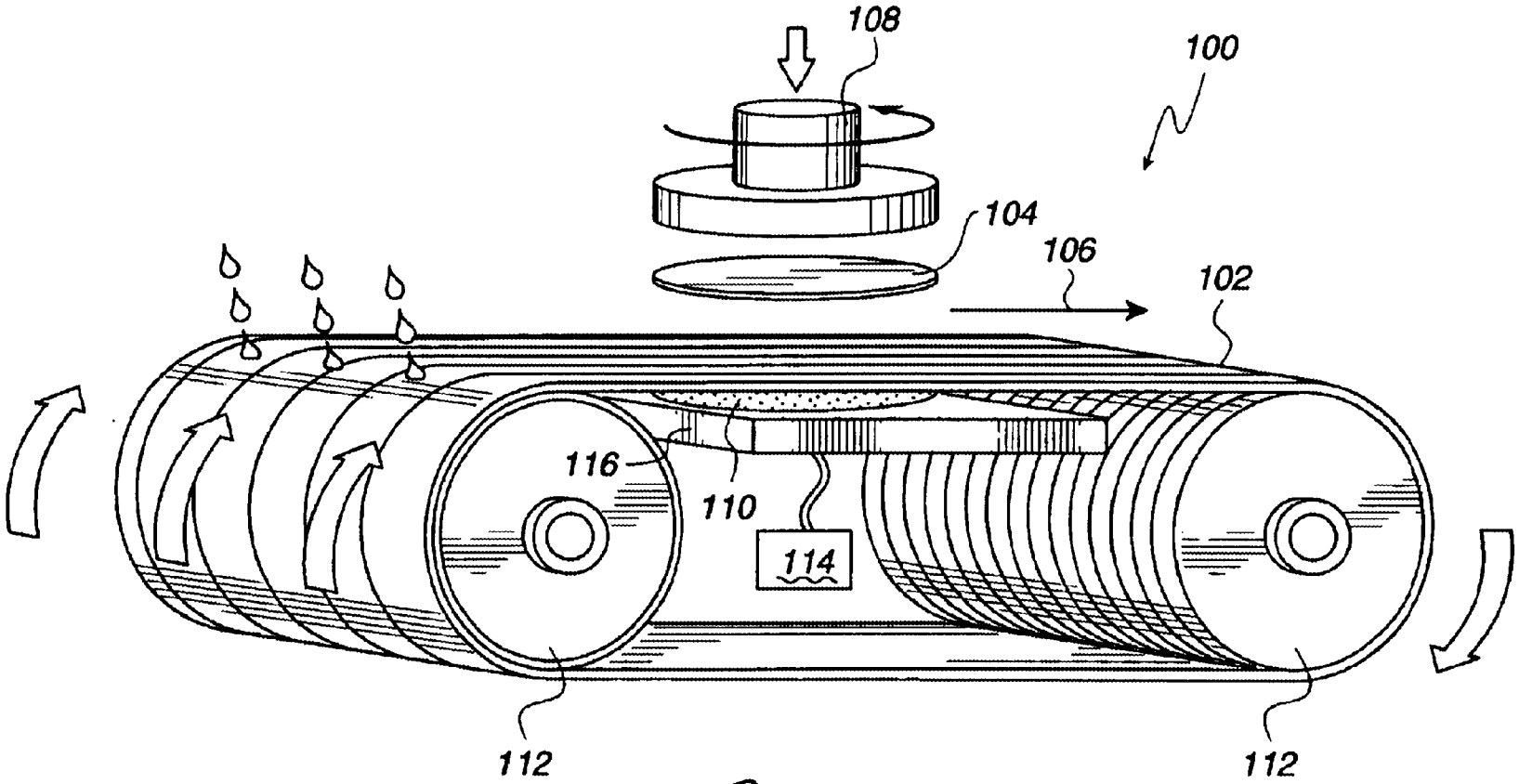
FIG. 2A shows a side view of a wafer linear polishing apparatus in accordance with one embodiment of the present invention.

FIG. 2A shows a side view of a wafer linear polishing apparatus 100 in accordance with one embodiment of the present invention. In this embodiment, a carrier head 108 may be used to secure and hold a wafer 104 in place during processing. A polishing pad preferably forms a continuous loop around rotating drums 112 while applying force to the pad from the top side. The polishing pad 102 generally rotates in a direction 106 at a speed of about 400 feet per minute, but this speed may vary depending upon the specific CMP operation. As the polishing pad 102 rotates, the carrier 108 may then be used to lower the wafer 102 onto a top surface of the polishing pad 102. A platen manifold assembly 110 may support the polishing pad 102 during the polishing process. The platen manifold assembly 110 may utilize any type of bearing such as a fluid bearing or a gas bearing. The platen manifold assembly 110 is supported and held into place by a platen surround plate 116. Fluid pressure from a fluid source 114 inputted through the platen manifold assembly 110 by way of independently controlled pluralities of output holes may be utilized to push up on the polishing pad 102 to control the polishing pad profile. As described below in reference to FIGS. 3–8, different zones may apply pressure in a different manner thereby specifying the polishing pressure on different parts of the wafer such as, for example, in a leading edge and trailing edge of the wafer 104. In this manner, the surface of the wafer 106 that is desired to be planarized is substantially smoothed in an even manner.

Figure 2B:
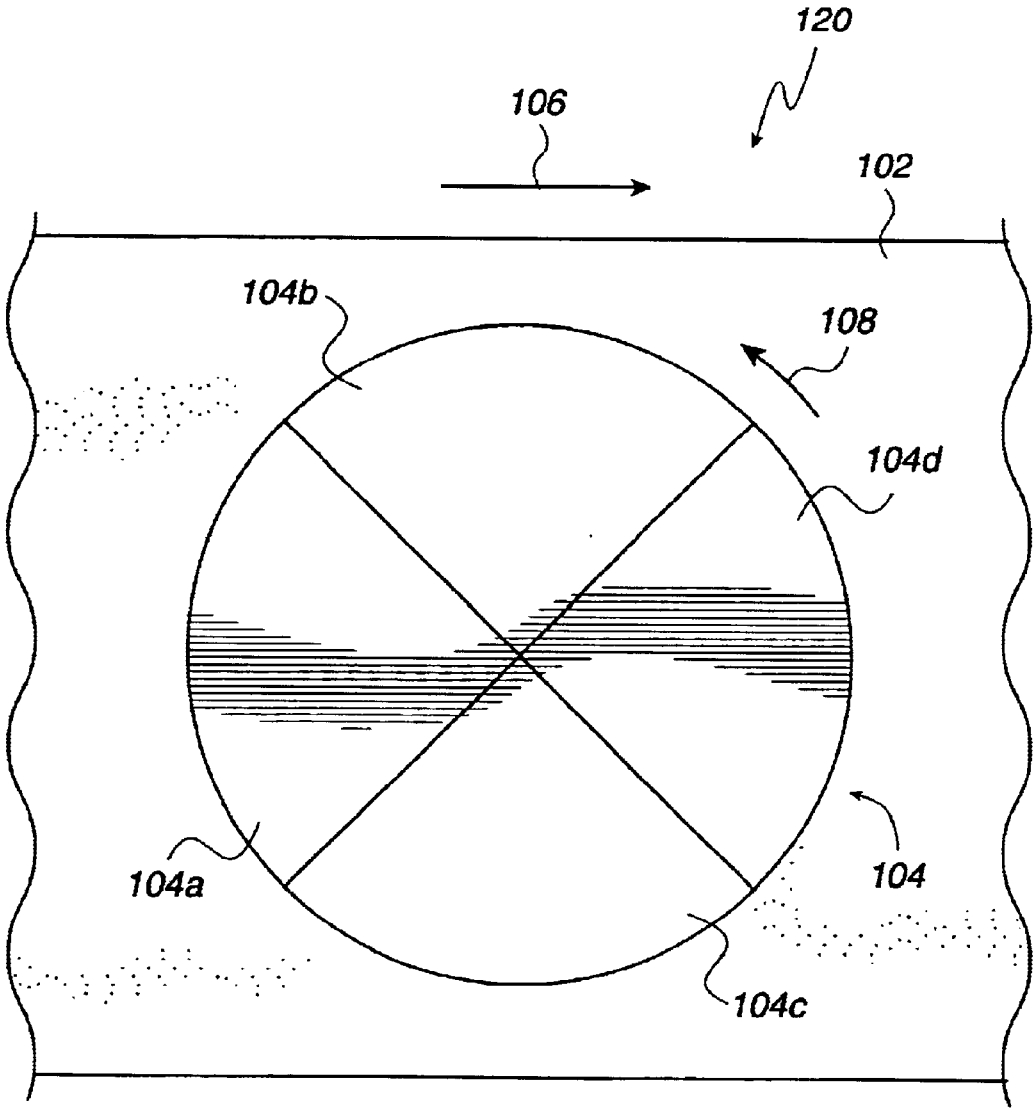
FIG. 2B shows a top view of a wafer linear polishing process as may be conducted by the linear polishing apparatus in accordance with one embodiment of the present invention.

FIG. 2B shows a top view of a wafer linear polishing process 120 as may be conducted by the linear polishing apparatus 100 in accordance with one embodiment of the present invention. In some cases, the CMP operation is used to planarize materials such as copper (or other metals), and in other cases, it may be used to remove layers of dielectric or combinations of dielectric and copper. The rate of planarization may be changed by adjusting the polishing pressure. The polishing rate is generally proportional to the amount of polishing pressure applied to the polishing pad 102 against the platen manifold assembly 110 (as shown in FIG. 2A) below the polishing pad 102. In one embodiment, the polishing pad 102 moves in a direction 106 and a friction produced by the movement of the polishing pad 102 assists in the polishing process. Therefore, in this embodiment, the wafer 104 may have four distinct polishing regions. It should be understood that although the embodiment described here has four polishing regions, the present invention may have any multitude of polishing regions or sub regions such as, for example, 5 regions, 6 regions, 7 regions, 8 regions, 9 regions, and so on. The four distinct polishing regions may be a leading edge polishing region 104*a* (also known as a leading zone), a side polishing region 104*c* (also known as a side zone), a side polishing region 104*b* (also known as a side zone), and a trailing edge polishing region 104*d* (also known as a trailing zone). The side polishing regions 104*b* and 104*c* differ slightly because the wafer 102 is typically rotating during the polishing process. If the wafer is rotating in a direction 108 then the region 104*b* has a greater differential polishing velocity than the region 104*c*. This means that the region 104*b* is moving against the direction 106 of the polishing pad 102 while the region 104*c* is moving with the direction 106. Therefore, polishing pressures on the region 104*b* may be slightly higher than the region 104*c* although not to a significant degree.

The trailing edge region 104*d* tends to have less polishing pressure due to variations in polishing pad deformations. In practice, the differences in polishing pressures on the leading edge 104*a* and the trailing edge region 104*d* are significant. Therefore, through independent control of fluid pressure under the regions 104*a–d*, the a polishing pressure, especially under the regions 104*a* and the region 104*d* may be adjusted to provide optimal and consistent polishing pressures over the different regions of the wafer 104. Consequently, the present invention controls at least the polishing pressures on the leading edge 104*a* and the trailing edge 104*d* to optimize the wafer polishing process.

Figure 3:
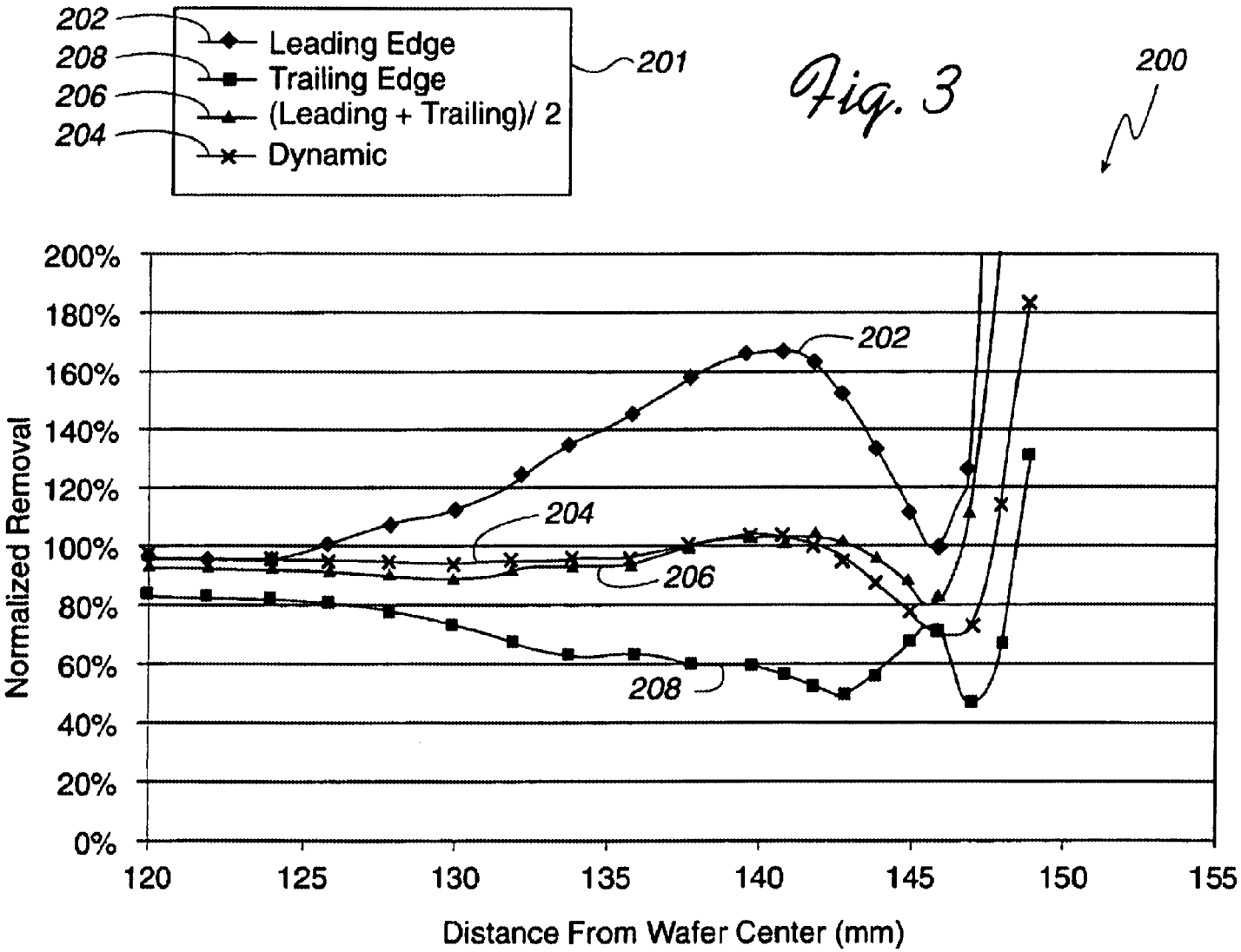
FIG. 3 shows a graph depicting differing polishing effects depending on how far from a center of the wafer that the polishing is taking place in accordance with one embodiment of the present invention.

FIG. 3 shows a graph 200 depicting differing polishing effects depending on how far from a center of the wafer that the polishing is taking place in accordance with one embodiment of the present invention. Graph 200 also includes a legend 201 indicating the names for curves shown on the graph 200. In this embodiment, the polishing rates of the leading edge 104*a* and the trailing edge 104*d* (as shown in FIG. 2B) are compared with a dynamic polishing, and leading and polishing rates divided by 2. A curve 202 shows a leading edge polishing profile and a curve 208 shows a trailing edge polishing profile. A curve 204 shows a dynamic (when the wafer is spinning) polishing profile and a curve 206 shows an average of the polishing profiles for the trailing edge and the leading edge. As can be seen, the trailing edge profile curve 208 has a lower and flatter normalized polishing removal than the leading edge profile curve 202. To alleviate the large differential in edge polishing, the present invention utilizes differing fluid pressures applied by a platen in different regions of the contact area between the polishing pad and the wafer to make wafer polishing more consistent. Therefore, the present invention may be utilized to flatten out the curves 202 and 208 to generate more consistent polishing in on the edges of the wafer. Such independent management of fluid pressure by the platen is described in further detail in reference to FIGS. 4–8.

Figure 4:
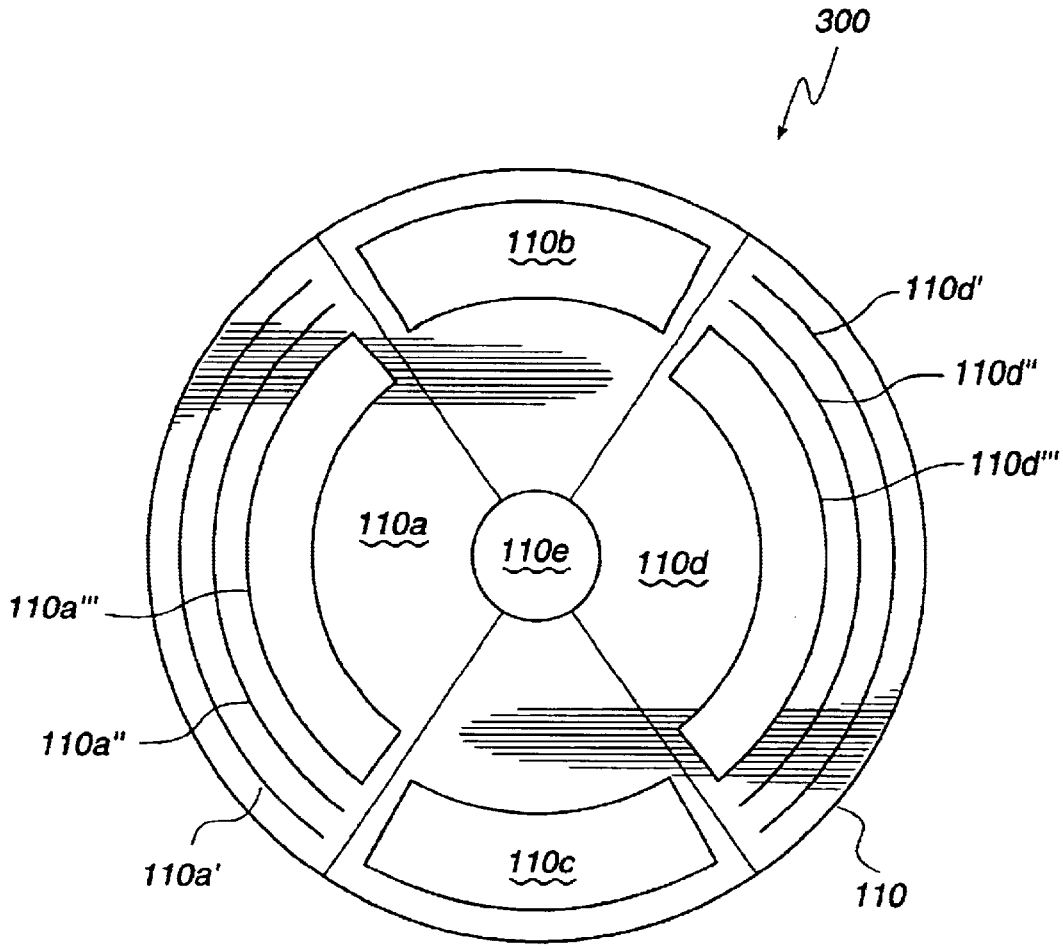
FIG. 4 shows a fluid opening layout of a platen manifold assembly in accordance with one embodiment of the present invention.

FIG. 4 shows a fluid opening layout 300 of a platen manifold assembly 110 in accordance with one embodiment of the present invention. In this embodiment, the platen manifold assembly 110 is segregated into 4 major platen regions 110*a–d* controlling polishing pressure applied to 8 different parts of the wafer 104. The platen regions 10*a–d* control polishing pressures on the regions 104*a–d* (as shown in FIG. 2B) of the wafer 104 respectively. The region 110*b* includes 5 radial rows of a plurality of fluid outputs to control polishing pressure on a first side region of the platen manifold assembly 110. The term radial rows as utilized herein are semicircular rows that are perpendicular to the radius from the center of the platen manifold assembly 110.

The region 110*c* includes include 5 radial rows of a plurality of fluid outputs control polishing pressure on a second side region of the platen manifold assembly 110. It should be understood that although the embodiments described herein do not separately control the regions 110*b* and 110*c*, the present invention may control each of the regions 110*a–d* separately. In one embodiment, each of the separately controllable regions such as the regions 10*a–d* may be designed to communicate independent fluid flows through the separately controllable regions to the underside of the linear polishing pad to intelligently control polishing pressure.

In another embodiment, the region 110*a* (also known as the leading zone) and the region 110*d* (also known as the trailing zone) may be independently controlled and designed to output a controlled fluid flow independently from each of the first plurality of output holes in the leading zone and the second plurality of output holes in the trailing zone.

In one embodiment, the platen region 110*a* is a leading edge region that includes three sub regions each containing a plurality of fluid outputs. Sub region-1 110*a'* and sub region-2 110*a*" each includes one radial row of a plurality of fluid outputs while sub region-3 110*a'''* include 3 radial rows of a plurality of fluid outputs. By dividing the platen region 110*a* into three sub regions each containing a plurality of outputs, the platen region 110*a* may intelligently, accurately, and precisely control polishing pressure on the leading edge region 104*a* of the wafer 104. In addition, because of the advantageous effects of applying more minute control of the outermost edges of the wafers, having single controllable radial rows of the sub regions 110*a*' and 110*a*" enables more accurate management of polishing pressure to an area that may provide a significant planarization improvement while polishing in the area of pad deformities.

In one embodiment, the platen region 110*d* is a trailing edge region that includes three sub regions each containing a plurality of fluid outputs. Sub region-4 110*d*' and sub region-5 110*d*" each includes one radial row of a plurality of fluid outputs while sub region-6 110*d''* may include 3 radial rows of a plurality of fluid outputs. The three sub regions I 110*d*'–110*d'''* each contains a plurality of outputs which enables the platen region 110*d* to intelligently and accurately control polishing pressure on the trailing edge region 104*d* of the wafer 104. Furthermore, having single controllable radial rows of the sub regions 110*a* and 110*a* " enables more accurate management of polishing pressure on the trailing edge of the wafer 104 which, due to polishing pad deformities, may require a higher control of polishing pressure management.

A center region 110*e* containing a circular plurality of fluid outputs which may also be utilized to control the polishing pressures and the resulting polishing dynamics of the wafer 104. Consequently, the present invention may control fluid pressure and the resultant polishing pressure by varying and adjusting fluid pressure in any, some, or all of the regions and sub regions of the platen.

Figure 5:
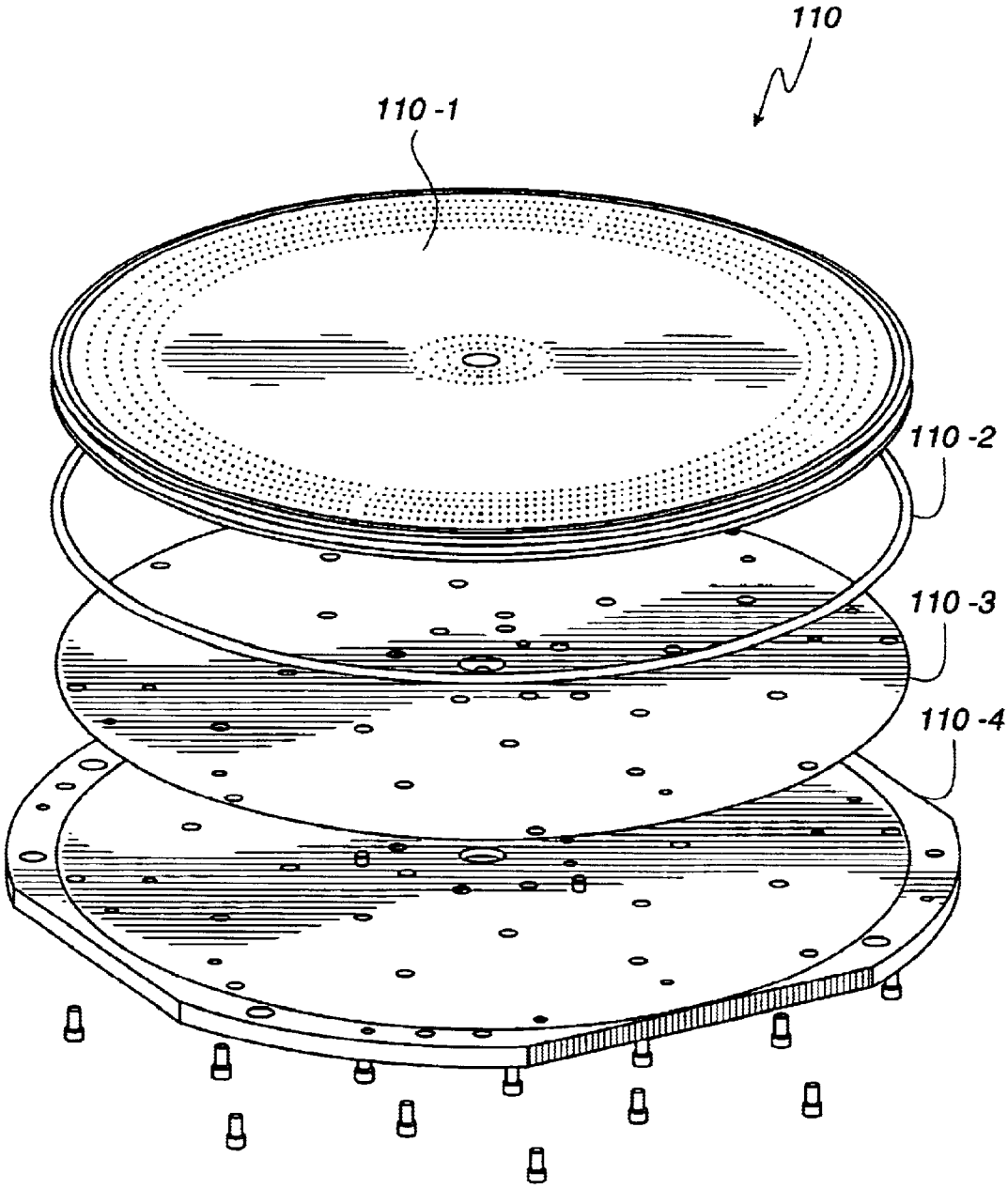
FIG. 5 illustrates a platen manifold assembly in accordance with one embodiment of the present invention.
Figure 8:
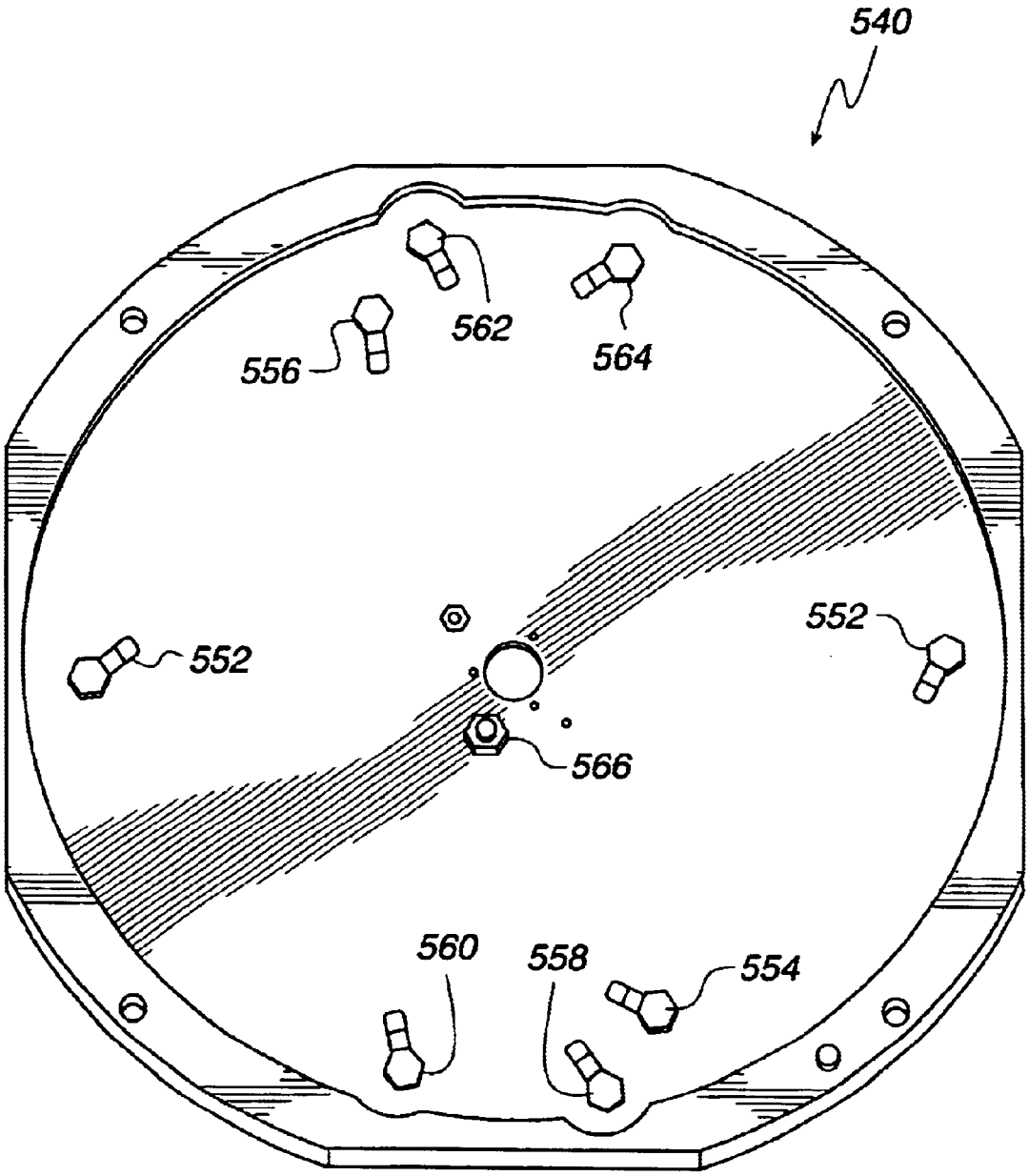
FIG. 8 shows a platen interface assembly in accordance with one embodiment of the present invention.

FIG. 5 illustrates a platen manifold assembly 110 in accordance with one embodiment of the present invention. In this embodiment, a rubber gasket 110-3 is sandwiched between a platen manifold assembly 110-1 and a base plate 110-4. Therefore, fluid tubes may be connected to a platen interface assembly 540 (shown in FIG. 8) which may transfer fluids to the platen 110-1. The o-ring 110-2 forms a seal to a platen surround plate 116 (shown in FIG. 9) so that contaminating fluids do not leak into the subsystem. Certain inputs located on the base plate 110-4, which correlate to the fluid tube inputs on the platen interface plate 540 (as shown in FIG. 8), may lead to certain regions or sub regions containing the plurality of fluid outputs so by controlling fluid introduction into the certain inputs, fluid output from the respective regions or sub regions may be controlled.

Figure 6:
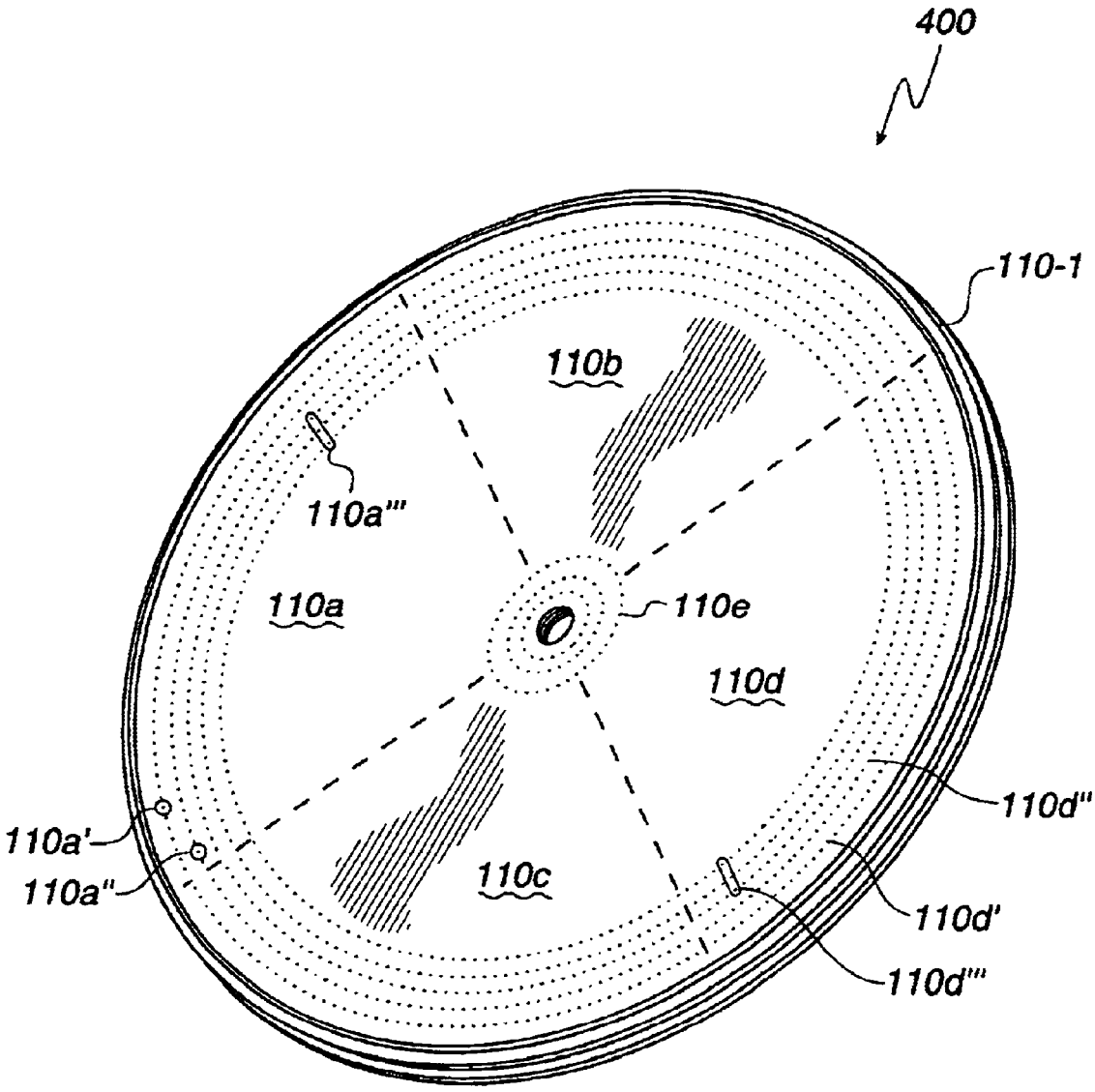
FIG. 6 shows a top view of the platen in accordance with one embodiment of the present invention.

FIG. 6 shows a top view 400 of the platen 110-1 in accordance with one embodiment of the present invention. In one embodiment, the platen 110-1 includes the 4 major regions 110*a*–110*d* (as described in reference to FIG. 2B) that may be controlled to optimize edge polishing. The region 110*a* may include the sub regions 110*a*'–110*a*'''. The sub region 110*a*' and the sub region 110*a*" can each contain a single radial row of a plurality of fluid outputs. Outputs from each of the sub regions 110*a*'''–110*a*''' may be individually controlled thereby enabling intelligent dynamic fluid output pressure by the platen manifold assembly 110 in the region 110*a* of the leading edge. It should be understood that fluid outputs to the sub regions 110*a*'–110*a*''' may be varied in any way which would manage polishing pressure in the leading edge and produce a more efficient wafer polishing such as, for example, decreasing polishing pressure. In one embodiment, the outputs closer to the edge such as those in sub regions 110*a* ' and 110*a*''' may be utilized (to lower fluid pressure and therefore polishing pressure) to reduce polishing pressure in the leading edge region 110*a*. By having single radial rows of a plurality of fluid outputs that are each individually controllable, more minute adjustments may be made toward the edge of the platen manifold assembly 110 thereby managing polishing pressure in the regions where polishing pad deformations occur.

The region 110*d* includes the sub regions 110*d*'–110*d*'''. Each of the sub regions 110*d*' and 110*d*''' can be managed individually by different outputs of fluid which can allow intelligent dynamic fluid output pressure variation by the platen manifold assembly 110 in the region 110*d* of the trailing edge. It should be appreciated that outputs to the sub regions 110*d*'–110*d*''' may be individually varied in any manner than would reduce polishing pad deformity and thereby enable more consistent wafer polishing. In one embodiment, the sub regions 110*d*' and 110*d*" may have more fluid inputted into them thereby increasing fluid output from the platen which increases fluid pressure on the polishing pad which in turn increases polishing pressure in the trailing edge. Such increased trailing edge polishing pressure may equalize the polishing pressure with the leading edge polishing pressure thus generating increased wafer polishing uniformity in the different regions of the wafer.

In one embodiment, the platen 110-1 may have a plurality of output holes that are separately grouped so there is a first region and a second region of output holes. The first region of output holes and the second region of output holes may then be separately controlled so as to apply a different magnitude of the force to the leading edge of the wafer than the trailing edge of the wafer and therefore powerfully control polishing pressure applied to the leading edge of the wafer and the trailing edge of the wafer.

Figure 7:
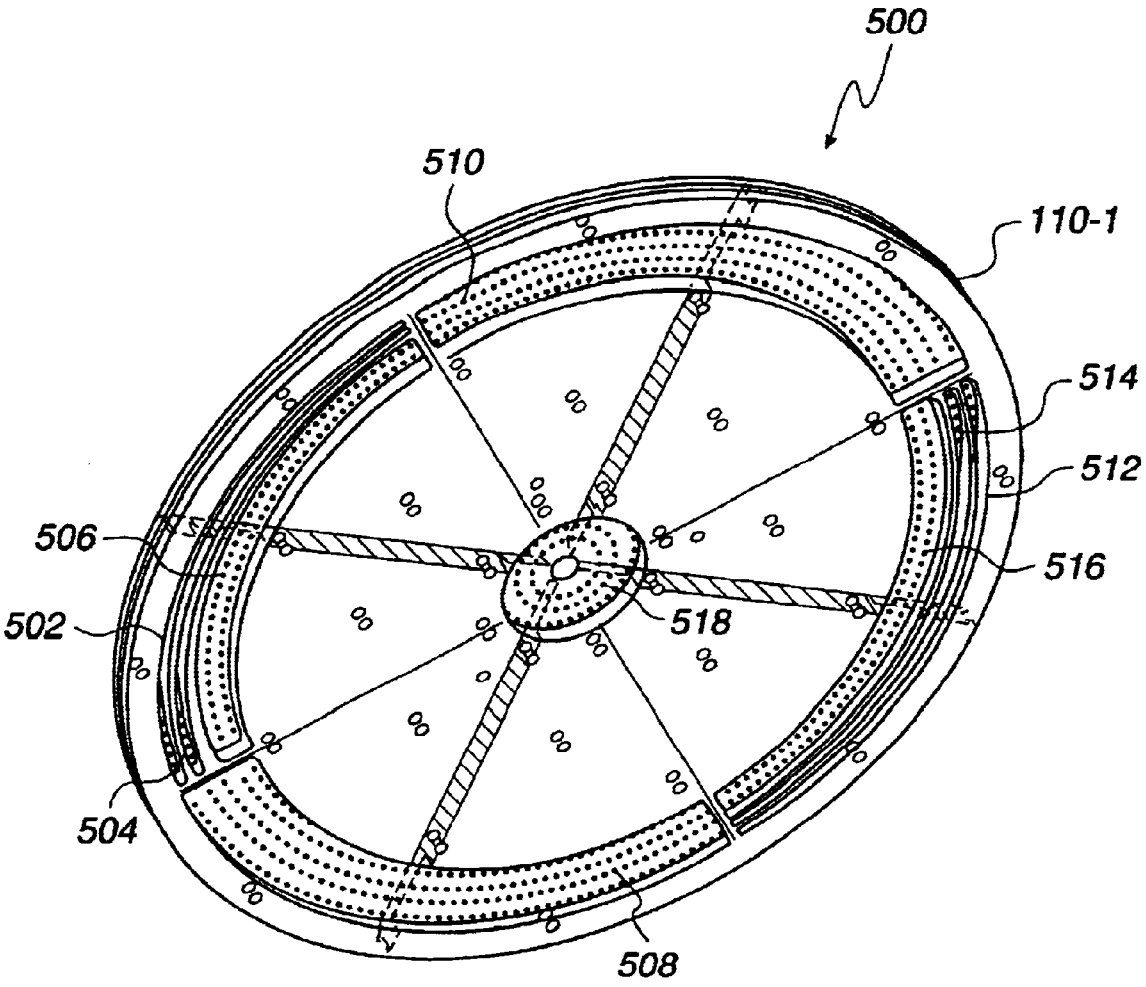
FIG. 7 shows a backside view of the platen in accordance with one embodiment of the present invention.

FIG. 7 shows a backside view 500 of the platen 110-1 in accordance with one embodiment of the present invention. In this embodiment, openings leading to the plurality of fluid outputs in the regions 110*a–e* (as shown in FIG. 6) can be seen. Openings 502, 504, 506, 512, 514, and 516 lead to a plurality of outputs in the sub regions 110*a*', 110*a*", 110*a*''', 110*d*', 110*d*", and 110*d*'''respectively. Also openings 508, 510, and 518 lead to a plurality of outputs in the regions 110*c*, 110*b*, and 110*e* respectively. Fluid input to each of the openings 502–518, fluid may be individually controlled so the different regions and sub regions containing the plurality of fluid outputs on the platen 110-1 may be managed to reduce polishing pressure differences between different parts of the wafer.

FIG. 8 shows a platen interface assembly 540 in accordance with one embodiment of the present invention. It should be appreciated that the platen interface assembly 540 may include any number of input holes depending on the number of zones and/or sub regions being controlled. In one embodiment, the platen interface assembly 540 includes 9 input holes. In one embodiment, two input holes 552 feed fluid into the plurality of output holes in regions 110*b* and 110*c* (regions 110*a*–110*e*, subregions 110*a*'–110*a*''', and subregions 110*d*'–110*d*''' are shown in FIGS. 4 and 6) of the platen manifold assembly 110. In addition, input holes 558, 560, and 554 may feed fluid into the plurality of output holes in sub regions 110*a*'–110*a*''' respectively. Also, input holes 562, 564, and 556 may feed fluid into the plurality of output holes in sub regions 110*d*'–110*d*''' respectively. Finally, an input hole 566 may feed fluid to the sub region 110*e*. By varying fluid entry into the input holes 552–566, fluid output out of each of the regions on the platen may be controlled individually or in any combination to intelligently adjust fluid pressures (and polishing pressure) on different parts of the polishing pad to increase equalization of polishing pressures on the different regions of the wafer thereby generating more consistent wafer polishing.

Figure 9:
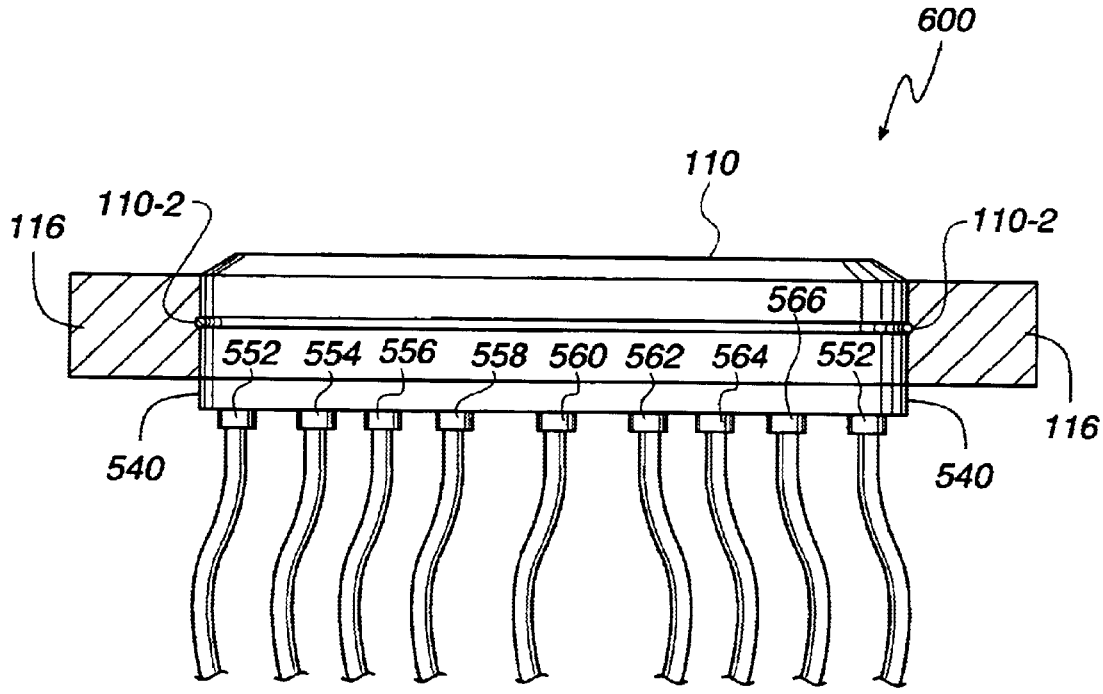
FIG. 9 shows a platen assembly with a platen manifold assembly, a platen interface assembly, and a platen surround plate in accordance with one embodiment of the present invention.

FIG. 9 shows a platen assembly 600 with a platen manifold assembly 110, a platen interface assembly 540, and a platen surround plate 116 in accordance with one embodiment of the present invention. It should be understood that the platen assembly 600 may be a one piece apparatus with the regions including the plurality of output holes built into the one piece apparatus, or the platen assembly 600 may include a multi-piece apparatus including the platen manifold assembly 110 attached to the platen interface assembly 540 where the platen manifold assembly 110 is fitted into the platen surround plate 116. The o-ring 110-2 forms a seal between the platen manifold assembly 110 and the platen surround plate 116 so that contaminating fluids do not leak into the subsystem. Regardless of the construction of the platen assembly 600, it may control fluid pressure through use of different plurality of output holes in different regions of the platen assembly 600. In one embodiment, the platen assembly 600 includes the platen manifold assembly 110 which has multiple zones of the plurality of output holes that is placed into and connected with a recess in the platen surround plate 116. The platen assembly 600 may include inputs 552, 554, 558, 560, 562, 564, and 566 which may introduce fluid into the different regions of the platen assembly 600 as described in further detail in reference to FIG. 8.

It should be understood that any type of fluid may be utilized in the present invention to adjust pressure on the polishing pad from the platen manifold assembly 110 such as, for example, gas, liquid, and the like. Such fluids may be utilized in the present invention to equalize polishing pressure on a wafer. Therefore, by use of any type of fluid compound, the plate structure may control individual outputs into certain regions of the platen manifold assembly 110.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. A platen for use in chemical mechanical planarization (CMP) systems, the platen arranged below a linear polishing pad and designed to apply a controlled fluid flow to the underside of the linear polishing pad, the platen comprising:

a leading zone containing a first plurality of output holes, the leading zone oriented more proximate to an upstream region of the linear polishing pad;

a center region containing a third plurality of output holes; and a trailing zone containing a second plurality of output holes; the trailing zone oriented more proximate to a downstream region of the linear polishing pad, the leading zone and the trailing zone and the center region being independently controlled and designed to output the controlled fluid flow independently from each of the first plurality of output holes and the second plurality of output holes and the third plurality of output holes, each of the leading zone and the trailing zone has a first sub region, a second sub region, and a third sub region;

wherein the first sub region includes a first radial row of output holes, the second region includes a second radial row output holes, and the third sub region includes a third radial row, a fourth radial row, and a fifth radial row of output holes.

2. A platen for mounting under and supporting a linear polishing pad during chemical mechanical planarization (CMP) operations, the platen being designed to apply a force to the underside of the linear polishing pad as a wafer is applied to a top surface of the polishing pad, the wafer being applied substantially over the platen so as to define the linear polishing pad between the wafer and the platen, the platen comprising:

a plate having a plurality of output holes, each of the output holes designed to output a fluid flow, the plurality of output holes being separately grouped so as to define a first region and a second region of output holes and a third region of output holes, the first region being oriented substantially under a leading edge of the wafer and the second region being oriented substantially under the trailing edge of the wafer and the third region being oriented in a center region of the plate, the first region of output holes and the second region of output holes being separately controlled so as to apply a different magnitude of the force to the leading edge of the wafer than the trailing edge of the wafer, each of the first region and the second region having a first sub region, a second sub region, and a third sub region;

wherein the first sub region includes a first radial row of output holes, the second region includes a second radial row of output holes, and the third sub region includes a third radial row, a fourth radial row, and a fifth radial row of output holes.

3. A platen for use in chemical mechanical planarization (CMP) systems as recited in claim 1, wherein the first plurality of output holes are located in the first sub region, the second sub region, and the third sub region.

4. A platen for use in chemical mechanical planarization (CMP) systems as recited in claim 3, wherein the first sub region, the second sub region, and the third sub region are separately controllable regions being designed to communicate independent fluid flows through the separately controllable regions.

5. A platen as recited in claim 2, wherein the first sub region, the second sub region, and the third sub region are separately controllable, each of the first sub region, the second sub region, and the third sub region being designed to communicate independent fluid flows through the separately controllable sub regions to the underside of the linear polishing pad.

6. A platen for use in chemical mechanical planarization (CMP) systems as recited in claim 1, wherein the second plurality of output holes are located in the first sub region, the second sub region, and the third sub region.

7. A platen for use in chemical mechanical planarization (CMP) systems as recited in claim 6, wherein the first sub region, the second sub region, and the third sub region are separately controllable regions designed to communicate independent fluid flows through the separately controllable regions.

8. A platen for mounting under and supporting a linear polishing pad during chemical mechanical planarization (CMP) operations, the platen comprising:

a plate including a plurality of separately controllable regions, each of the separately controllable regions being designed to communicate independent fluid flows through the separately controllable regions to the underside of the linear polishing pad, and a leading zone having one of the plurality of separately controllable regions, the plurality of separately controllable region being a first sub region having at least one radial row of output holes and a second sub region having a plurality of radial rows of output holes.

9. A platen assembly for supporting an underside of a linear polishing pad, comprising:

a platen surround plate;

a platen interface assembly;

a platen manifold assembly being configured to be connected to the platen interface assembly, the platen manifold assembly being configured to be supported by the platen surround plate, the platen manifold assembly including, a base plate;

a gasket configured to fit on the base plate, an O-ring configured to fit around the platen;

a platen, the platen including a plurality of separately controllable regions, each of the separately controllable regions being designed to communicate independent fluid flows through the separately controllable regions to the underside of the linear polishing pad.

10. A platen assembly for supporting an underside of a linear polishing pad as recited in claim 9, wherein the fluid flows are one of gas flows and liquid flows.

11. A platen assembly for supporting an underside of a linear polishing pad as recited in claim 9, wherein the fluid flows are liquid flows.

12. A platen assembly for supporting an underside of a linear polishing pad as recited in claim 9, wherein the separately controllable regions are a leading zone and a trailing zone.

13. A platen assembly for supporting an underside of a linear polishing pad as recited in claim 9, wherein the separately controllable regions are a leading zone and a trailing zone, and two side zones.

14. A platen assembly for supporting an underside of a linear polishing pad as recited in claim 12, wherein the leading zone and the trailing zone each have separately controllable sub regions to communicate the independent fluid flows.

15. A platen assembly for supporting an underside of a linear polishing pad as recited in claim 14, wherein each of the leading zone and the trailing zone have at least three separately controllable sub regions.

16. A platen as recited in claim 8, wherein the separately controllable regions include, a first zone, a second zone, a third zone, and a fourth zone.

17. A platen as recited in claim 16, wherein the first zone is the leading zone and the second zone is a trailing zone relative to the linear polishing pad when in motion.

18. A platen as recited in claim 16, wherein the third and fourth zones are side zones.

19. A platen as recited in claim 17, wherein each of the first zone and the second zone contain sub-regions of separately controllable regions, each of the sub-regions being capable of delivering independent fluid flows.

20. A platen as recited in claim 17, wherein the independent fluid flow of the leading zone is designed to reduce pressure to the underside of the linear polishing pad and the independent fluid flow of the trailing zone is designed to increase pressure to the underside of the linear polishing pad.

21. A platen as recited in claim 8, wherein the platen is connected to a base plate by way of a gasket configured to fit on the base plate and an O-ring configured to fit around the platen.

22. A platen as recited in claim 17, wherein the trailing zone includes one of the plurality of separately controllable regions, the plurality of separately controllable region being a first sub region having at least one radial row of output holes and a second sub region having a plurality of radial rows of output holes.

23. A platen as recited in claim 8, wherein the plate includes a center region containing a plurality of output holes.

* * * * *